United States Patent [19]

Massey

[11] Patent Number: 4,536,426

[45] Date of Patent: Aug. 20, 1985

[54] SELF ADHESIVE NAIL OVERLAY OR WRAP

[76] Inventor: Becky L. Massey, 25799 N. Player Dr., Valencia, Calif. 91355

[21] Appl. No.: 549,964

[22] Filed: Nov. 9, 1983

[51] Int. Cl.[3] ..... A45D 31/00

[52] U.S. Cl. ..... 428/42; 132/73; 156/61; 428/15

[58] Field of Search ..... 132/73; 428/15, 40, 428/914, 42; 156/61

[56] References Cited

U.S. PATENT DOCUMENTS

| | | | |
|---|---|---|---|
| 2,581,982 | 1/1952 | Terry | 132/73 |
| 2,816,555 | 12/1957 | Klump | 132/73 |
| 3,425,426 | 2/1969 | Welanetz | 132/73 |
| 3,898,357 | 8/1975 | Miller et al. | 428/15 X |
| 4,151,319 | 4/1979 | Sackoff et al. | 428/352 X |

*Primary Examiner*—Henry F. Epstein
*Attorney, Agent, or Firm*—John E. Kelly

[57] ABSTRACT

The invention provides a major improvement in the application methods of various materials adhered to the nail for purposes of strengthening natural nails, artificial nail tip extensions or both, in part by eliminating an unnecessary and time consuming application step. A strip of nail overlay has one side coated with pressure sensitive non-permanent bonding adhesive and it is permeable to permit the passage of bonding glue. A strip of release backing paper is superimposed on and secured to the nail overlay—and is arranged to be separated from it after sections of the superimposed strips have been cut to the general outline of a human nail. A coat of glue is applied to the top of the nail overlay to bond it to the human nail.

3 Claims, No Drawings

SELF ADHESIVE NAIL OVERLAY OR WRAP

FIELD OF THE INVENTION

This invention relates to nail overlays or wraps used primarily by professionals in the beauty and nail industry.

BACKGROUND OF THE INVENTION

Self adhesive nail overlay or wrap is a product used by and designed for professional manicurists and/or pedicurists within the beauty industry or nail industry, although anyone knowledgeable in the application methods can apply the product.

The invention is an improvement in the application of the materials used as a nail overlay or wrap that is adhered to the human fingernail or toenail which provides strength and durability to the nail and aids in the overall beauty of the nail.

An "overlay" or "wrap" is defined as the method and total area to which the material used as the overlay or wrap is applied to the natural nails or nail tip extensions, or both. When applying an "overlay," the material is adhered to the top of the natural nail or nail tip extension or both. When applying a "wrap," the material is adhered to the top of the natural nail or nail tip extensions or both and also beneath that portion of the nail which extends past the end of the finger or toe.

SUMMARY OF THE INVENTION

This invention comprehends both a product and process for improving the strength and durability of a human nail.

Material for providing strength and durability to a human nail includes a strip of nail overlay having one side coated with pressure sensitive non-permanent bonding adhesive. The nail overlay is permeable, so as to permit the passage therethrough of bonding glue. A strip of release backing paper is superimposed on and secured to the nail overlay and is arranged so as to be separated from the nail overlay after sections of the superimposed strips have been cut to the general outline of a human nail. When the nail overlay material is generally positioned and worked into alignment on the human nail, permanent bonding glue is applied to the top of the nail overlay.

The process aspects of this invention involve shaping the nail overlay to a human nail to be strengthened and then simultaneously cutting the nail overlay and release backing paper to the general outline of the human nail. The release backing paper is separated from the nail overlay and then the nail overlay is adhered to the human nail with non-permanent bonding material. Thereafter a coat of glue is applied to the top of the nail overlay to permanently bond it to the human nail.

DETAILED DESCRIPTION OF THE PREFERRED EMBODIMENT

The invention of a self adhesive nail overlay or wrap becomes a fundamental necessity to the professional manicurist or pedicurist who is concerned about conserving time so as to acquire more clients each working day.

Before this invention, it was necessary to apply a first or primary coating of glue to the natural nail or artificial nail tip extension or both before applying the overlay or wrap material to the nail. This conventional application method was time consuming and, due to the fast drying glues used, the professionals had to quickly line-up the materials used as the overlay or wrap and place it on or around the nail. As soon as the material touches the glue, the professional cannot normally lift it off the nail and re-apply the material if she/he makes a mistake. The material most commonly used as conventional overlay or wrap is 100% Chinese silk.

This invention eliminates the need for the primary or first coating of glue onto and/or around the natural nail or artificial nail tip extension-because it has a sticky, non-permanent bonding surface on one side of the material. The self-adhesive nail overlay or wrap of this invention is a strip of material such as 100% Chinese silk, coated on one side with a pressure sensitive adhesive. A silicon treated release paper backing is pressed onto the material containing the pressure sensitive adhesive to protect the adhesive from deteriorating elements.

The finished product is cut into conveniently sized strips and packaged. Various sized packages can be made according to the needs of the buyer. The professional manicurist or pedicurist simply cuts and shapes a piece of the self adhesive nail overlay or wrap to the fingernail or toenail and then separates the material from the backing paper. The overlay or wrap is then placed onto the nail with the adhesive side on the nail. To make the material permanently bonded to the nail, a final coat of glue is applied to the top of the nail overlay or wrap.

The self adhesive nail overlay or wrap can be, for purposes of illustration, produced from fabrics such as 100% Chinese silk, cotton, nylon, polyester, satin, linen, rayon, wool, or blends of these fabrics. The fabric is permeable so as to permit the passage therethrough of bonding glue.

The nail overlay or wrap of this invention eliminates the need for a primary or first coating of glue on top of and/or around the fingernail or toenail. The nail overlay or wrap material is coated on one side with a pressure sensitive adhesive.

The backing material used to protect the pressure sensitive glue from deteriorating elements includes by way of example, the following materials: silicon or Quillon treated release paper, parchment, crepe or plastic.

From the foregoing, it will be evident that this invention has provided a greatly improved product and process to achieve many benefits.

I claim:

1. The process of strengthening and protecting human nails with a permeable nail overlay having one side coated with a pressure sensitive adhesive of non-permanent bonding material and secured to release backing paper-comprising the sequential steps of:

(a) shaping the nail overlay to a human nail to be strengthened;

(b) simultaneously cutting the nail overlay and release backing paper to the general outline of the human nail;

(c) separating the release backing paper from the nail overlay;

(d) adhering the nail overlay to the human nail with non-permanent bonding material; and, (e) applying a coat of glue to the top of the nail overlay and permanently bonding the nail overlay to the human nail.

2. Material for providing strength and durability to a human nail, comprising:

(a) a strip of nail overlay having one side coated with pressure sensitive non-permanent bonding adhesive, the nail overlay being permeable so as to permit the passage therethrough of a bonding glue;

(b) a strip of release backing paper superimposed on and secured to the nail overlay-and arranged to be separated from the nail overlay after sections of the superimposed strips have been cut to the general outline of a human nail;

(c) whereby the nail overlay material may be generally positioned and worked into alignment on the human nail before a permanent bonding glue is applied to the top of the nail overlay.

3. The subject matter in accordance with claim 2 wherein:

the nail overlay material is fabric and the release backing paper is silicon treated.

* * * * *